US006324982B1

(12) United States Patent
Eybert-Berard et al.

(10) Patent No.: US 6,324,982 B1
(45) Date of Patent: Dec. 4, 2001

(54) PROCESS FOR ARTIFICIALLY TRIGGERING AN AVALANCHE AND DEVICE FOR APPLYING THIS PROCESS

(75) Inventors: André Eybert-Berard, Sassenage; Jean-Michel Taillandier, Herbeys; Jean-Pierre Berlandis, Crolles, all of (FR)

(73) Assignee: Commissariat A l'Energie Atomique, Paris (FR)

( * ) Notice: Subject to any disclaimer, the term of this patent is extended or adjusted under 35 U.S.C. 154(b) by 0 days.

(21) Appl. No.: 09/554,218

(22) PCT Filed: Nov. 16, 1998

(86) PCT No.: PCT/FR98/02441

§ 371 Date: Aug. 11, 2000

§ 102(e) Date: Aug. 11, 2000

(87) PCT Pub. No.: WO99/26039

PCT Pub. Date: May 27, 1999

(30) Foreign Application Priority Data

Nov. 17, 1997 (FR) ..... 97 14366

(51) Int. Cl.[7] ..... F42B 10/00; F42B 12/00; F42B 14/06; F42B 30/00; F42B 8/00

(52) U.S. Cl. ..... 102/363; 102/301; 102/324

(58) Field of Search ..... 102/363, 301, 102/302, 323, 324

(56) References Cited

U.S. PATENT DOCUMENTS

| | | | | |
|---|---|---|---|---|
| 3,658,005 | * | 4/1972 | Byrne | 102/6 |
| 4,422,382 | * | 12/1983 | Marz | 102/331 |
| 4,873,928 | * | 10/1989 | Lowther | 102/323 |
| 5,107,765 | * | 4/1992 | Schippers | 102/302 |
| 5,872,326 | * | 2/1999 | Manhart | 102/439 |

* cited by examiner

*Primary Examiner*—Charles T. Jordan
*Assistant Examiner*—M. Thomson
(74) *Attorney, Agent, or Firm*—Burns Doane Swecker & Mathis LLP

(57) ABSTRACT

The invention involves a process for artificially triggering an avalanche. The invention process includes a first step of filling at least one flexible envelope with an explosive fluid and a second step of triggering an explosion of the aforesaid fluid within each envelope, each envelope being destroyed by the explosion of the fluid. The destruction of the envelope allows for propagation of an aerial spherical overpressure wave which will affect an optimal area of the blanket of snow to be removed and will shake the aforesaid area and trigger an avalanche. The invention also involves a device for applying this process, the aforesaid device including at least one envelope to contain the explosive fluid, and means to trigger the explosion of this fluid within each envelope.

21 Claims, 4 Drawing Sheets

PROCESS FOR ARTIFICIALLY TRIGGERING AN AVALANCHE AND DEVICE FOR APPLYING THIS PROCESS

FIELD OF THE INVENTION

The invention involves a process for artificially triggering an avalanche and more generally a process for artificial triggering of a natural phenomenon in which one or several explosions of a fluid are triggered in a predetermined zone where this phenomenon is to be triggered.

The invention can be applied in all areas where a phenomenon can be triggered or started with local overpressure of the atmosphere above the zone affected by the phenomenon.

The invention is typically applied to artificial triggering of avalanches of snow at winter sport resorts and at sites where there is a potential risk to people such as ski trails, mechanical lifts, roads, mountain railroads and, in general, public and private constructions and developments.

The invention also involves a device for applying this process including the means to trigger at least one explosion of a fluid in a predetermined area where the aforesaid phenomenon is to be triggered.

STATE OF THE ART

Several means now exist for artificially triggering an avalanche from a predetermined zone, by causing local overpressure of the atmosphere in the aforesaid zone.

For example, one of these means involves placing or throwing explosive charges such as TNT and then triggering the explosion of these charges. The explosion creates a blast which sweeps the surface of the blanket of snow in the avalanche zone, and a shock wave which shakes the base of this blanket and triggers an avalanche.

The handling of these explosive changes is a risky operation regardless of the precautions taken by the users. These charges are also generally polluting.

Another means is the system marketed under the name GAZEX. This means is described in patent application FR-A-2 636 729. It involves using a device including a cannon or metallic tube with a closed bottom, and a frontal mouth opening in the direction of the blanket of snow. This device also includes a combustive gas supply circuit from a first source and a fuel gas supply circuit from a second source. Nozzles for filling the cannon with these gases are arranged in various places along the length of this cannon and an ignition device is mounted at the rear of the cannon. A gaseous mixture is formed within the cannon, for example a mixture of propane and oxygen, and the explosion of this mixture is triggered in the cannon by the ignition device.

The frontal mouth of the cannon diffuses the blast and the shock wave caused by the explosion on the surface of the snow blanket, thus triggering the avalanche.

While this approach has proven effective in many facilities, it has a certain number of drawbacks. The cannon is heavy, it can weigh several hundred kilograms, it is hard to move, unattractive and expensive. In addition, this system uses electronic valves to make the explosive gas mixture and thus requires numerous adjustments and verifications.

BRIEF DESCRIPTION OF THE INVENTION

This invention precisely aims to overcome the aforementioned drawbacks with a process for artificially triggering an avalanche by at least one explosion of an explosive fluid in a predetermined zone, the aforesaid process including a first step of filling at least one flexible envelope with an explosive fluid and a second step of triggering an explosion of the aforesaid fluid within each envelope, each envelope being destroyed by the explosion of the fluid.

The fluid can be inserted in the envelope by means of a diffuser, the diffuser being connected to a source of gas by means of a gas supply tube.

The flexible envelope can be directly attached to the diffuser which can then act as a fixed support for the flexible envelope during filling.

According to the invention process, the fluid can be an explosive gaseous mixture of a combustive and a fuel.

According to the invention, a combustible gas is used as a gaseous fuel. This combustible gas may be chosen from among the group of substances including hydrogen, petrol residues (such as tetraine commercialized by the French company Air Liquid), acetylene, propane, butane, or a mixture of these substances, but preferably hydrogen.

The combustive used can be, oxygen, ozone, air, or air enriched with oxygen or ozone, but preferably air.

According to the invention process, the fluid within each flexible envelope can be at a pressure equal to the atmospheric pressure or it may be substantially higher than it when the envelope(s) is (are) filled.

According to the invention process, each flexible envelope used must be made of a material which can be destroyed by the explosion of the fluid which it contains. The material of the flexible envelope and the thickness of this material must be chosen so that it releases the overpressure wave created by the explosion of the fluid that it contains, without presenting too much resistance to this explosion. This material must also be able to contain the fluid until the time of the explosion and it must be sealed.

According to a preferred embodiment of the invention, the flexible envelope can be made of a light material such that for a gaseous mixture forming a fluid which is lighter that the surrounding air, for example an explosive mixture of hydrogen and air, the envelope is held in a vertical position above the blanket of snow. This envelope could advantageously be bio-degradable to avoid polluting the environment.

An example of a flexible envelope with all of the previously-mentioned characteristics is an envelope made of a material chosen from the group including butyl rubber. The thickness of the material which makes up the envelope could be for example about 100 to 200 $\mu$m.

The envelope could be a balloon of the type used for weather balloons.

This flexible envelope must have a volume such that it can contain a sufficient volume of the fluid, at atmospheric pressure or at a slightly higher pressure, so that the explosion of this fluid triggers the avalanche. When the fluid is a mixture of hydrogen and air for example, the minimum volume of the envelope can be determined by the following reasoning, considering that the fluid in the envelope is at atmospheric pressure.

It is generally accepted that a force equivalent to the explosion of at least 3 kg of TNT is needed to trigger an avalanche in normal conditions, i.e. when there is a risk of a natural avalanche.

The following equation (I) is the chemical equation for the explosion of a mixture of $H_2$/oxygen in the air:

$$H_2+\tfrac{1}{2}O_2 \rightarrow H_2O \qquad \text{(I)}$$

This equation (I) shows that the stoichiometric mixture for the explosion in normal temperature and pressure conditions (273° Kelvin, and 101 325 Pa) includes two volumes of $H_2$ for one volume of $O_2$. When the fluid is a hydrogen/air mixture, this corresponds to 30% hydrogen and 70% air by volume. The explosion of 2 g of $H_2$ (1 mole of $H_2$) according to equation (I) supplies 57,800 calories, or about 60,000 calories, and the explosion of 1 g of TNT supplies 1000 calories, 1 g of $H_2$ thus being the equivalent of 30 g of TNT in terms of power. The density of hydrogen being 90 g/$m^3$, 1 $m^3$ of hydrogen is equivalent to 2700 g of TNT. Considering that for various reasons such as the quality of the gaseous mixture, the temperature, etc. the yield of the explosion is not equal to 1 but to 0.5, 1 $m^3$ of hydrogen can supply an energy equivalent to an explosion of 1.35 kg of TNT. It is therefore preferable to use a volume of hydrogen of 2.2 $m^3$ so that the detonation power is sufficient, i.e. equivalent to the explosion of 3 kg of TNT, to trigger the avalanche. This volume of hydrogen would then require a volume of air of 6.8 $m^3$ to obtain a stoichiometrically detonating mixture.

The minimum preferable volume of the envelope for the $H_2$/air mixture is thus 8.9 $m^3$ when the fluid filling the envelope is at atmospheric pressure.

According to the invention process, the volume of the envelope is thus chosen so as to be suitable for a volume of explosive fluid sufficient to trigger an avalanche and thus also depending on the nature of the fluid.

This process is thus adaptable because envelopes with different volumes can be used depending on the weather and geographic conditions.

According to the invention, the second step in the process is the triggering of an explosion of the fluid within each envelope. This explosion can be triggered by classic means of triggering an explosion which produces a spark in each envelope. These means can include for example a fuse, a piezoelectric device, a flint, etc.

The explosion of the fluid contained in each envelope causes the destruction of this envelope and the propagation of an aerial spherical overpressure wave which will affect an optimal area of the blanket of snow, a function of the volume of the explosive fluid in the envelope before the explosion, and will shake the aforesaid area, triggering an avalanche.

The flexible envelope(s) is (are) placed using a support above the blanket of snow in a predetermined area, i.e. a zone from which the avalanche can be triggered by local overpressure of the atmosphere. The zone is called the "avalanche starting zone" by professionals. This envelope (these envelopes) is (are) attached by means of a support which does not hinder the propagation of the blast and the shock wave created by the explosion of the fluid above the aforesaid predetermined area, at a distance of 2 to 3 m from the surface of the blanket of snow for example, for an envelope (envelopes) having a volume of 10 m3, filled with an explosive mixture of hydrogen and air.

According to the invention process, each flexible envelope can be folded up in a corresponding container. In this case the filling of this envelope also includes a phase of deployment of the aforesaid envelope outside of the aforesaid container.

The container must be made of a material which can withstand the explosion of the fluid contained in one of the envelopes when several envelopes in several corresponding containers are used.

According to the invention process, each container can be closed with a cap, the step of filling the corresponding envelope then includes a phase of ejection of the aforesaid cap to allow for deployment of the envelope.

The cap can be ejected by for example pressure from the fluid on the interior of the flexible envelope folded up in the container during the first step of filling of the aforesaid envelope with the fluid. This cap can be biodegradable to avoid polluting the environment, or can remain attached to the container so as to avoid hindering the deployment of the envelope outside of the aforesaid container.

According to a variant of the invention process, the step of filling each envelope can also include a phase of suction of the surrounding atmospheric air and the mixing of this air with an appropriate gas to form the explosive fluid.

The appropriate gas could be chosen from the group including hydrogen, helium, petrol residues (such as tetraine commercialized by the French company Air Liquid), acetylene, propane, methane, etc. or a mixture of these gases.

According to this variant, the air can be aspirated from the atmosphere for example and mixed with the gas(es) by means of a venturi-type depressurizing system referred to hereafter as a venturi system to be introduced into the envelope, the appropriate gas going through the venturi under pressure, drawing in the surrounding air by depressurizing.

The venturi system can be chosen such that for a given outflow of gas going through it, the air/gas mixture formed, at the output from this venturi, is an explosive mixture. In this way the mixture is made automatically by the venturi to be put into the envelope.

According to this variant, only one reserve of gas, hydrogen for example, is needed using a mixture of a single gas and atmospheric air. This process not require a mixed gas storage tank unlike the process marketed under the name GAZEX and described in patent application FR-A-2 636 729 and includes simpler hydraulic equipment, as only one gas tube is needed to link the tank to the device.

The venturi system optimises the efficiency and the reproducibility of the explosive mixture. It is a simple, static system which does not require sophisticated technology, has few parts and is thus inexpensive.

The fuel can advantageously be hydrogen, because the air/hydrogen mixture formed has a relatively wide explosive mixture range, i.e. from 13.5% by volume to 59% by volume, with a maximum detonation wave pressure at 32.5% hydrogen by volume, thus allowing rough measurement of the mixture not requiring special measurement equipment such as a flow meter.

In a particular embodiment of the invention, the diffuser to which the envelope can be attached can include the venturi system.

According to the invention process, several envelopes can be used. In this case the first and second steps which are related are done independently for each envelope.

Advantageously, when several envelopes are used, the introduction of the fluid into one of these envelopes and the explosion of the fluid in the aforesaid envelope can be controlled by an automatic incrementation system. This automatic incrementation system allows for control of the first and second steps which are related, for each envelope, successively, until all of the envelopes have been used.

According to the invention process, the filling of the various envelopes and their explosion can be done by remote control, the filling of each envelope being controlled by a remote-controlled solenoid valve.

The invention also involves a device for applying the invention process. This device for artificially triggering an avalanche by at least one explosion of an explosive fluid in a predetermined zone includes at least one envelope to contain the fluid, means for filling each envelope with the fluid, means to trigger the explosion of this fluid in each envelope and the means to control the filling of each envelope and to trigger each explosion, each envelope being made of a material such that it is destroyed by the explosion of the fluid which it contains.

According to the invention device, the fluid can be an explosive mixture of atmospheric air and at least one gas, the aforesaid means of filling then including means for suction of the surrounding atmospheric air.

According to the invention, the means of suction of the surrounding atmospheric air can be venturi type depressurizing systems.

According to the invention device, the flexible envelope is made of a material chosen from the group including butyl rubber. For example, a weather balloon with a volume of 10 $m^3$.

According to the invention, the means for triggering the explosion in the envelope can include a fuse placed in the envelope in contact with the fluid which it contains.

According to a variant of the device according to the invention, the device can also include a container for each envelope, the aforesaid envelope being folded up in the corresponding container when it is empty, so that it can come out of the aforesaid container and be deployed when the fluid is put into the envelope.

According to this variant, each container can also include an ejectable cap during the filling of the envelope with the fluid.

The containers and the corresponding ejectable caps are advantageously made of a material which can withstand the atmospheric overpressure due to the explosion of the fluid of one of the balloons. This material could for example be chosen from among the group including polypropylene, for the container and for the ejectable cap.

According to the invention, when the device includes several containers, they can be attached to a support anchored in the ground.

According to one embodiment of the invention, this support can include a first movable part to which the containers are attached and a second fixed part anchored in the ground.

The movable part must be attachable to the fixed part such that its position on the fixed part is not modified by the explosion of the envelopes. According to this embodiment, the movable part of the support can be replaced, when all of the envelopes have been used, by a new movable part to which the new envelopes and the corresponding containers are attached. Also according to the invention, and depending on the size of the explosion needed to trigger an avalanche in the predetermined area, a movable part including envelopes of a certain volume can easily be replaced by another movable part including envelopes of different volumes.

According to the invention, the anchoring in the ground does not require massive anchoring concrete, means of anchoring such as explosive piles are sufficient.

The device according to the invention can thus be easily transported due to the presence of a movable part and a part fixed in the ground by a rapid anchoring system, thus avoiding helicopter transport in some cases.

According to the invention, the fixed part and/or the movable part can allow for height adjustment so that the invention device can be installed in many different places.

The device should preferably be as compact as possible for good integration at the site and to provide good resistance to wind and snow creep.

The second fixed part can include a distributor for distribution of the gas in each envelope, means for controlling the filling of each of the envelopes, and means to control the explosion of the fluid in each of these envelopes.

According to the invention, the device can include an incrementation control system for the filling and explosion of the fluid in each of the envelopes in succession.

According to the invention, the device can preferably include means for remote control of the means of filling of each of the envelopes and explosion of the fluid in each of the envelopes.

According to the invention, each container can be cylindrical in shape and can include a first end formed with a bottom and a second end formed with an ejectable cap, the aforesaid cap being conical in shape.

According to the invention, the bottom of the container can be pierced by a gas supply tube, the aforesaid tube going through the cylindrical container essentially along its axis of symmetry, and stop at the conical cover with a diffuser to which the envelope can be attached, the aforesaid diffuser being used to put the fluid into the envelope.

The diffuser can include a venturi system including a lateral orifice for suction of the surrounding atmospheric air, the aforesaid orifice being preferably located at the level of the conical cap so as to facilitate air suction.

According to the invention, several containers and corresponding envelopes can be used and attached to the movable part of the support, these containers will be preferably arranged around a horizontal circle on the aforesaid support. For example, the support could hold 10, 15, 20 or 25 containers depending on the frequency of triggering of avalanches planned for the winter season.

According to the invention, when the fluid is an explosive mixture of air and gas, the gas is preferably hydrogen.

The device according to the invention, preferably including several envelopes, is implanted within a predetermined zone corresponding to an avalanche starting zone.

The invention device can be connected to a control station preferably located away from the invention device, i.e. in a non-avalanche zone. This control station can include for example the storage of the gas, for example hydrogen, a system for electrical control of the invention device, a remote control transmitter/receiver, and a battery and solar panel device to provide electricity.

The invention device offers numerous advantages such as reduced volume and weight, high mobility, good integration in the landscape, a reduced control station and gas reserve, reduced hydraulic equipment, a stoichiometrically explosive mixture obtained automatically, a minimal cost price, high efficiency and good respect for the environment.

The characteristics and advantages of the invention will be clearer with the reading of the description which follows. This description refers to an embodiment example which is explanatory but not limiting with reference to the drawings in appendix.

DETAILED DESCRIPTION OF AN EMBODIMENT OF THE INVENTION

Figure 1:
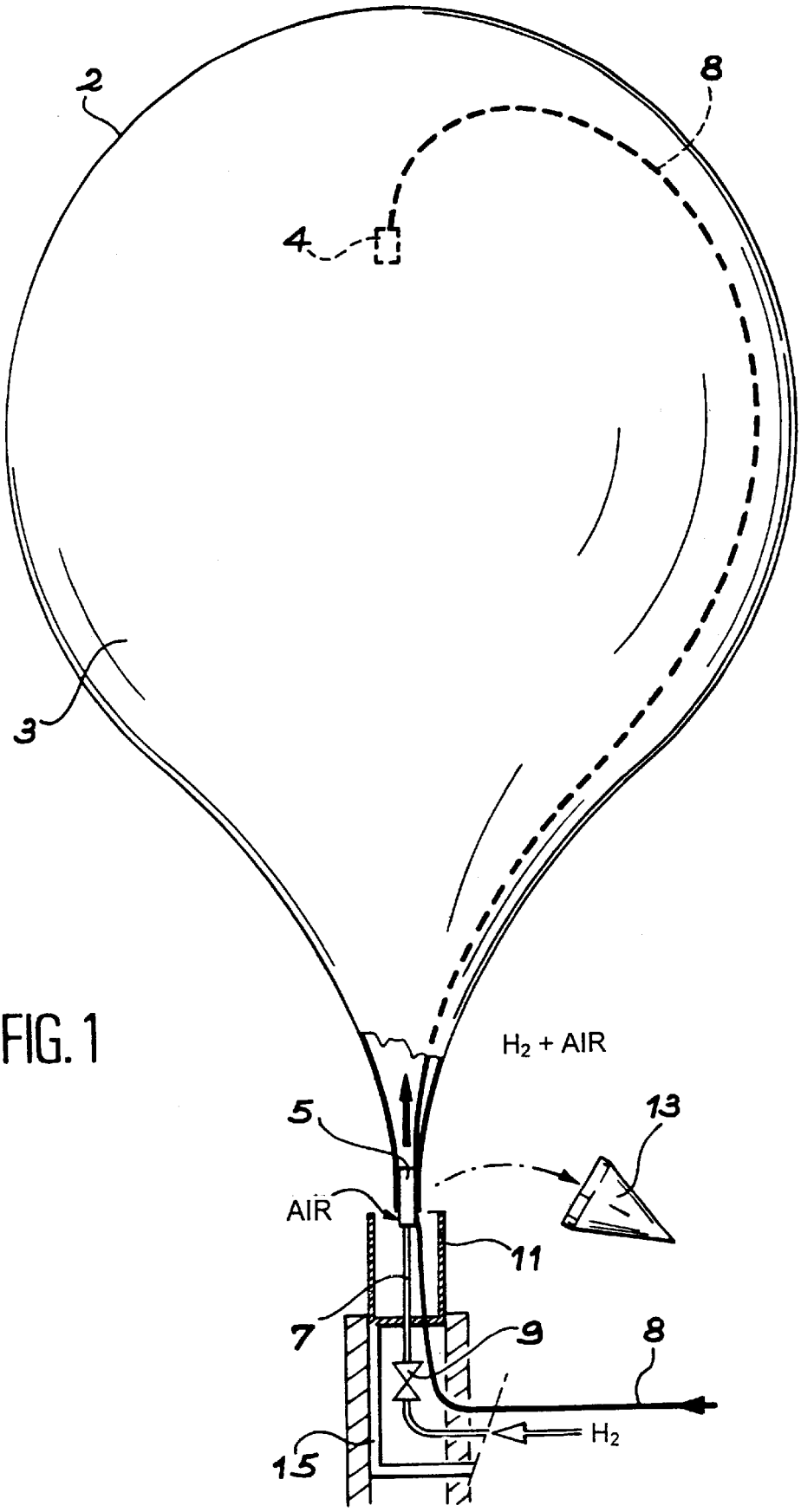
FIG. 1 is a diagram of the invention device illustrating an envelope filled with the explosive fluid.

With reference to FIG. 1, corresponding to the first step of the invention process, the device shown is essentially composed of an envelope 2, in the shape of a butyl rubber weather balloon, deployed and filled with a fluid 3 composed of a mixture of hydrogen and air. This envelope 2 is attached by means of an envelope maintaining ring 6 to a diffuser 5 which introduces the fluid into the envelope. The diffuser 5 is supplied with hydrogen under pressure of 3 to 6 Bar by a gas supply tube 7, the supplying of gas into this envelope being controlled by an solenoid valve 9. This figure also shows a container 11, in which the envelope was folded before being filled with the fluid, and an ejectable cap 13, which was ejected during the filling of the envelope with the fluid. The container 11 is attached to a support 15.

An electrical fuse 4 is placed in the envelope so that it is in contact with the explosive fluid put into this envelope. This fuse is linked to the means of control for triggering the explosion of the fluid in the envelope (not shown in this figure) by means of electricity-conducting wires 8. This fuse could have also been placed at the venturi system.

Figure 2:
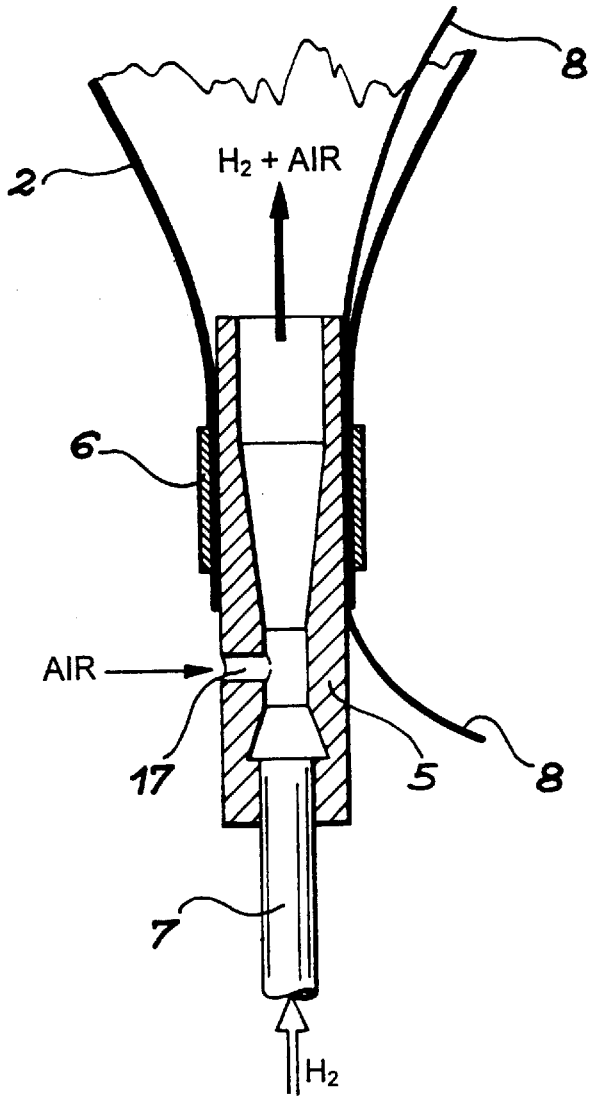
FIG. 2 is an enlargement of a cross section of a diffuser including a venturi system to which an envelope is attached.

FIG. 2 is an enlargement of a cross section of the diffuser 5 to which the envelope 2 is attached. The diffuser 5 includes a venturi system on which there is a lateral orifice 17 for suction of the surrounding atmospheric air. This venturi system allows for injection of surrounding atmospheric air into the envelope by suction, the flow of the hydrogen under pressure in this system being the driving force, thus forming the explosive fluid. The venturi system is chosen as a function of the hydrogen pressure of 3 to 6 Bar at the input into this system.

The tube 7 for supplying $H_2$ through the diffuser is an appropriate gas supply tube with a diameter of about 30 mm.

The hydrogen/air mixture formed includes 25% to 35% hydrogen by volume and 75% to 65% air by volume.

The electrical conducting wires 8 to supply the fuse 4 for the triggering of the explosion of the fluid in the envelope are also shown in this figure.

Figure 3:
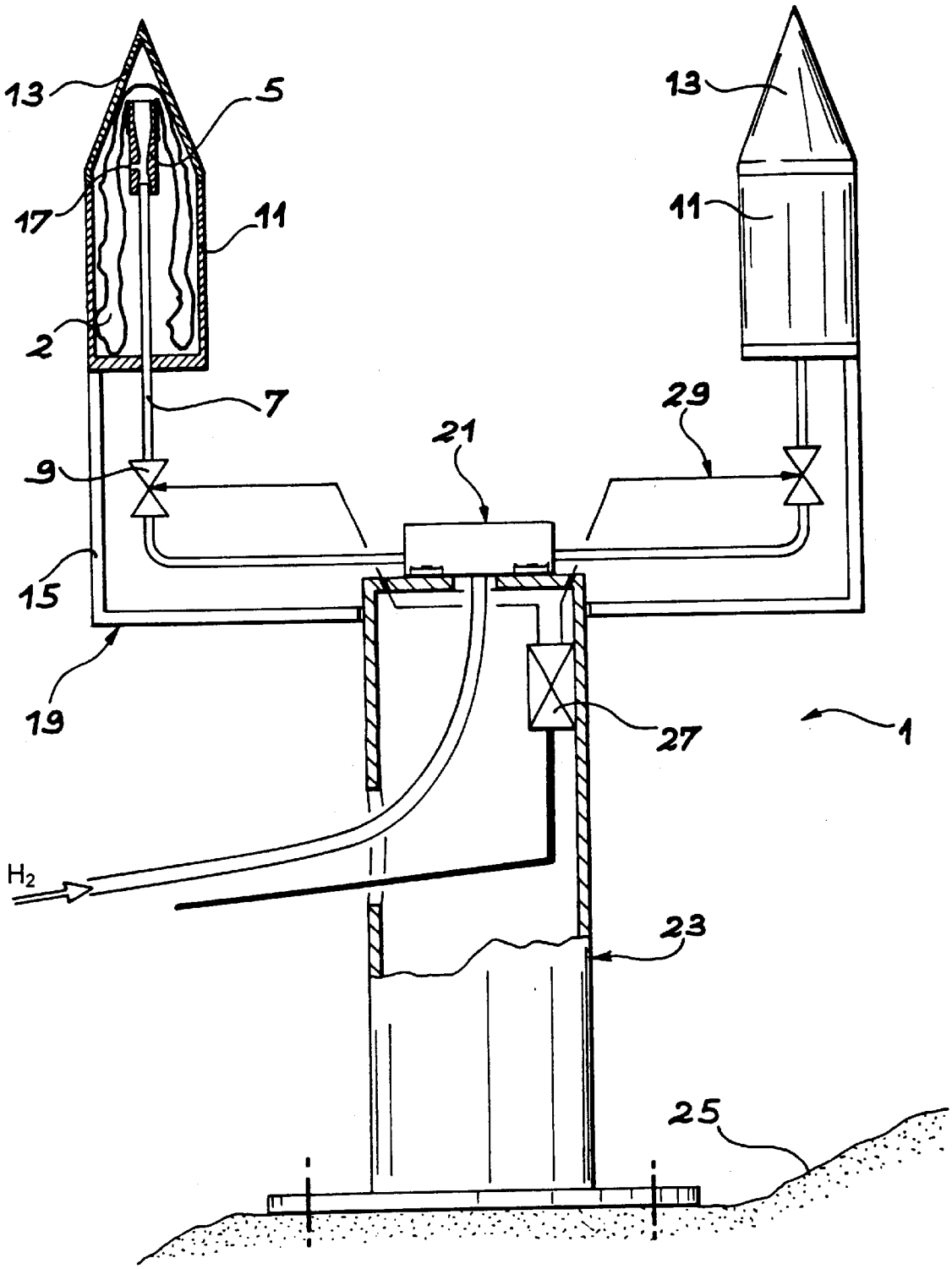
FIG. 3 is a cross section view of an embodiment of the device of this invention including several containers and their corresponding envelopes, showing in cross section a container in which an envelope is folded.

FIG. 3 is a cross section of an embodiment of a device 1 according to this invention including several envelopes 2 folded up in corresponding containers 11, showing in cross section a container 11 in which an envelope 2 is folded up so that it can come out of this container and be deployed when the fluid is introduced into the envelope. Each container is cylindrical in shape with a diameter of 60 to 80 mm. An ejectable conical cap 13 closes each container 11 to protect the corresponding envelope until it is filled by the fluid. The lateral orifice 17 of each venturi system is located under the ejectable cap 13 so that it can easily suck in atmospheric air when the hydrogen is injected through this system. During filling of the envelope with the fluid, the pressure applied by the fluid on the envelope causes the ejection of the cap 13 so that the envelope can leave the container and be deployed. The containers are attached to a support 15 forming the first movable support 19 of the device, the aforesaid first movable support 19 being attached to a fixed support 23, anchored in the ground 25, having a height 1 to 2.5 m. The supplying of each container is done by a solenoid valve 9 maintained at a temperature of −20° C. with low voltage power (12 or 25 V). All of the solenoid valves are grouped on a single distributor 21 placed on the fixed support 23. The fixed support 23 also includes a distributor 27 for electrical control of the solenoid valves 9 and fuses in each envelope (not shown) connected to each solenoid valve and to each fuse by means of an electrical multiconductor cable 29. This distributor 27 is carefully protected by a metal case and placed in the ground.

The containers are assembled in the factory, this assembly including the insertion of a fuse into each envelope, assembly and attaching of each envelope to a diffuser, folding of each envelope in each corresponding container and assembly of an ejectable conical cap on each container.

The device 1 is placed in an avalanche start zone.

Figure 4:
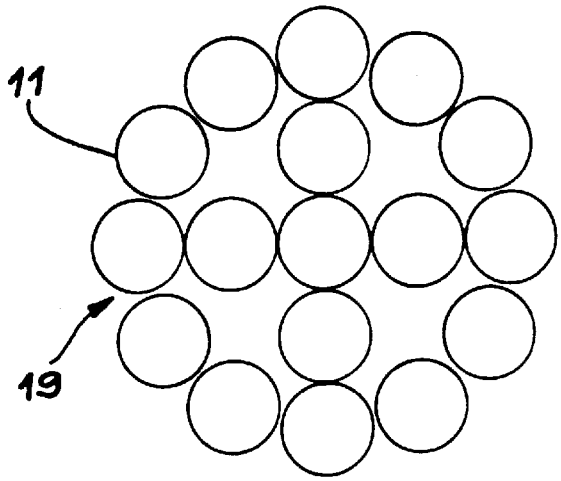
FIG. 4 is an overhead cross section view of the invention device in which several containers are used.

FIG. 4 is an overhead cross section view of the movable support 19 on which seventeen containers 11 and their corresponding envelopes 2 are arranged in a circle. This number can be modified according to the anticipated frequency of avalanche triggerings during the winter season.

The dimension characteristics of the movable support must be carefully defined based on the following factors:

- having the device be as compact as possible (integration at site, resistance to wind, snow creep, ground, etc.)
- adjustable height (a single system must be suitable for multiple locations),
- avoiding the use of massive anchoring concrete (anchoring with explosive piles or other quick means),
- being easily transported (disassembled) to avoid helicopter transport as much as possible,
- The balloon holders must be able to withstand the overpressure due to the explosion of one of the balloons (maximum explosion pressure 10 to 15 Bar, the overpressure on the balloon holders should not exceed several hundred mBar).

Figure 5:
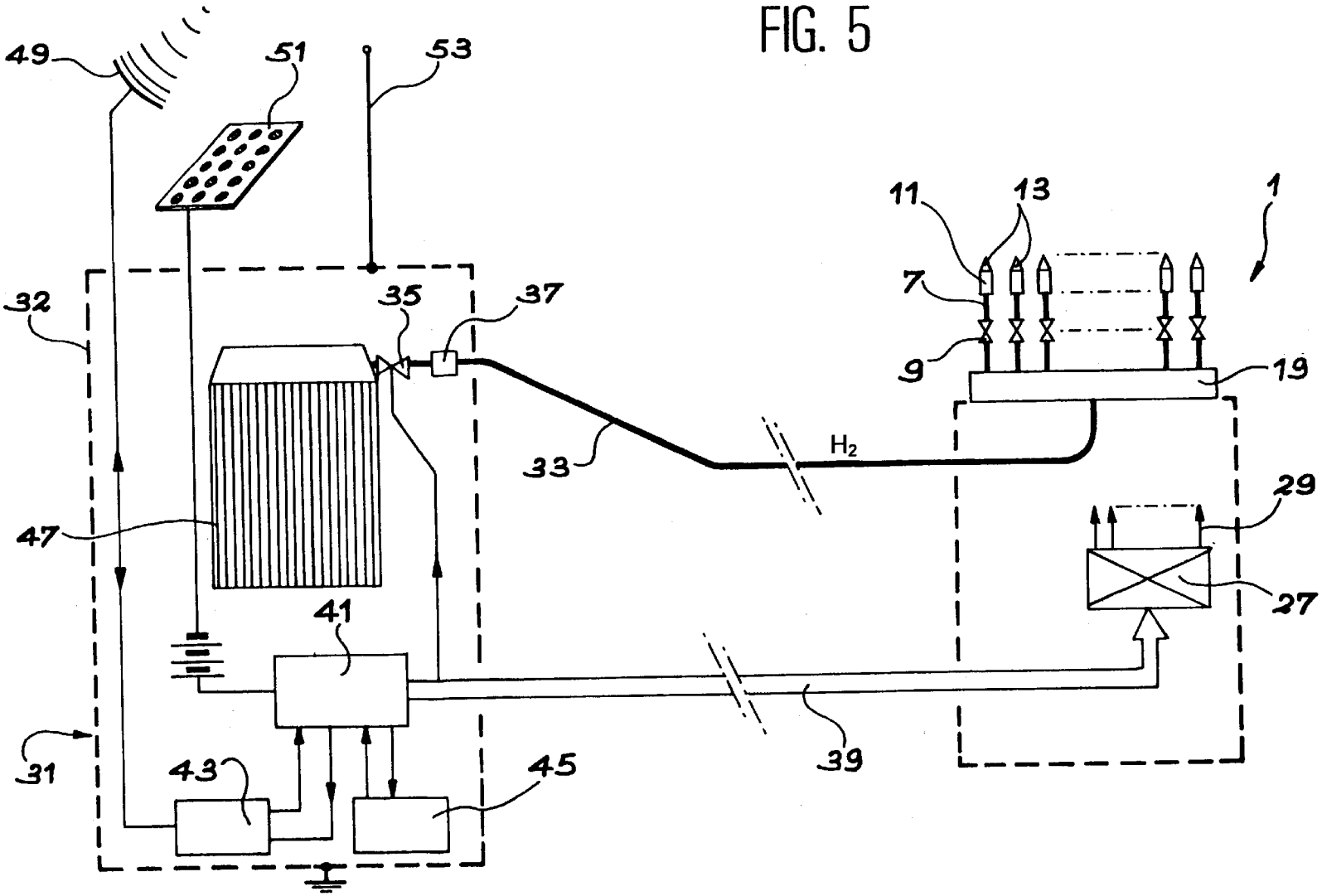
FIG. 5 is a general diagram of a device according to the invention and of its control station.

FIG. 5 is a general diagram of a device 1 according to the invention and its control station 31.

The control station 31 is located higher with respect to the avalanche start zone in which the device 1 is placed.

The control station 31 is composed of a faradised shelter 32 which can be transported by helicopter in its functional position.

This shelter includes:

- a reserve of hydrogen 47 in the form of a frame for 9 to 11 tanks,
- a main solenoid valve 35 and a 37 HP/LP (high pressure/low pressure) single pressure reducing valve, 180/10 Bar,
- an electrical power supply needed to operate the means of control for the device according to the invention including two 12 V batteries, 80 Ah, heat-insulated, as backup with a solar panel 51, 24 V, 1000 W, placed on the shelter.
- an electronic control box including an interface between the transmitter/receiver 43 and a means of control 41 of the solenoid valves 9 for the filling of each envelope and the means of triggering the explosion of the fluid in each envelope.
- a means of control 45 of the filling of each envelope and the triggering of the corresponding explosion,
- a transmission/reception antenna 49 allowing for remote control of the control station and a lightning rod 53 to protect the shelter from lightning.

Each tank has a volume of 50 liters and contains 9000 liters of hydrogen at a pressure of 180 Bar. For the total of 11 tanks, this represents a volume of 99000 liters of hydrogen at atmospheric pressure. Considering that the hydrogen is depressurized to a pressure of 4 Bar for the filling of the envelopes, the available volume will be 176×50×11 or 96800 liters of hydrogen. For each filling of an envelope 2 having a volume of 10 $m^3$ with an explosive mixture of hydrogen and air, 2200 liters of hydrogen are used. This frame is thus sufficient for about 40 fillings of 10 $m^3$ envelopes.

The shelter is placed on the ground on a metallic mesh, the plane of the soil being along the mass and anchored. Upper and lower air vents, protected from entry of snow and insects, are included to avoid any accumulation of hydrogen in the shelter.

The shelter is protected against intrusion by a locked door which is not shown.

There are connections between the control station 31 and the device 1 according to the invention. These connections are a hydrogen supply tube 33 from the control station 31 to the device 1, and a transmission cable 39 to control the solenoid valves 9 and fuses in each envelope.

The tube 33 is a medium pressure tube, sheathed by a metallic mechanical protection tube and casing and anchoring at scattered intervals to avoid its being torn out by creeping snow or fallen rocks. The casing of this tube is connected to the mass of the shelter and the mass of the device 1. The interior diameter of this tube is 8 to 10 mm in order to decrease the head loss along its length.

The main solenoid valve 35 controls the hydrogen supply line from the control station to the device 1 through the tube 33, the HP/LP single pressure reducing valve 37, 180/10 Bar allowing for adjustment of the static pressure of the hydrogen leaving this pressure reducing valve in the tube 33, to 4 to 6 Bar. The static pressure leaving the single pressure reducing valve 37 is regulated according to the length of the tube 33 between the control station and the device 1.

The static pressure of hydrogen in the tube 33 and the rolling diameter of each solenoid valve 9 determine the filling time for each envelope. This filling time is preferably 1 to 2 minutes to take account of wind, rubbing of each envelope against the rough parts of the device, etc.

The cable 39 is a multipaired, shielded cable including mechanical and electrical protection. It has a number of pairs as a function of the number of envelopes in the device 1. Each pair is shielded. This cable 39 provides the electrical connection between the control station 31 and the distributor 27 for electrical control of the solenoid valves 9 and the fuses, which are not shown, for each envelope.

The outputs from the faradised shelter, i.e. the passages for the electrical cables 39 and for the medium pressure tube 33 for transport of hydrogen to the device 1, for the antenna 49, and the solar panel 51 through this shelter are protected by coaxstop or equivalent systems.

An electronic coding system allows for automatic incrementation, filling and explosion control from a destroyed envelope to an envelope folded up in a container.

The following example is an example of the operation of the device according to the invention.

The transmitter/receiver 43 at the control station 31 is constantly on stand-by due to the electricity supplied by the battery and the solar panel. It can be activated by remote control for example from a general control centre for ski trails based on the following mode of functioning:

Turning on of the control station and the device 1—report of the order—opening of the main solenoid valve 35—report of order—opening of the solenoid valve 9 of a first envelope and filling of the aforesaid envelope in 1 to 2 minutes—report of order—closing of the aforesaid solenoid valve 9—report of order—command to the corresponding fuse: EXPLOSION. Report of order. Incrementation to a second envelope folded in a container, turning off, returning of the control station and the device 1 to stand-by mode.

What is claimed is:

1. Process for artificially triggering an avalanche by at least one explosion of an explosive fluid in a predetermined zone, the aforesaid process including a first step of filling at least one flexible envelope with an explosive fluid, and a second step of triggering an explosion of the aforesaid fluid within each envelope, each envelope being destroyed by the explosion of the fluid which it contains, wherein each flexible envelope being folded up in a corresponding container, the step of filling of this envelope includes a phase of deployment of the aforesaid envelope outside of the aforesaid container.

2. Process according to claim 1, in which each container being closed by a cap, the step of filling of the corresponding envelope includes a phase of ejection of the aforesaid cap to allow for deployment of the envelope.

3. Process according to claim 2, in which the step of filling each envelope includes a phase of suction of atmospheric air and mixing of this air with an appropriate gas in order to form an explosive fluid.

4. Process according to claim 3, wherein the suction of the atmospheric air and mixing of this air with an appropriate gas in order to form an explosive fluid is carried out with a venturi system.

5. Process according to claim 1, in which as several envelopes are used, the first and second steps which are related are controlled independently for each envelope.

6. Process according to claim 5, in which the filling of the various envelopes and their explosion is successively triggered by remote control.

7. Device for artificially triggering an avalanche by at least one explosion of an explosive fluid in a predetermined zone, the aforesaid device including at least one envelope to contain the explosive fluid, means for filling each envelope with fluid, means for triggering the explosion of this fluid in each envelope and means to control the filling of each envelope and to trigger each explosion, each envelope being made of a material such that it is destroyed by the explosion of the fluid which it contains, the aforesaid device also including a container for each envelope, the aforesaid envelope being folded up in the corresponding container when it is empty so that it can come out of the container and be deployed when the fluid is introduced into the envelope.

8. Device according to claim 7, in which the fluid being an explosive mixture of atmospheric air and at least one gas, the aforesaid means of filling include means for suction of the surrounding atmospheric air.

9. Device according to claim 8, in which the means of suction of the surrounding atmospheric air are venturi systems.

10. Device according to claim 7, in which the means of triggering the explosion in the envelope include a fuse.

11. Device according to claim 7, in which each container includes a cap which can be ejected when the fluid is put into the envelope.

12. Device according to claim 7, including several containers attached to a support anchored in the ground.

13. Device according to claim 12, in which the support includes a first movable part to which the containers are attached, and a second fixed part anchored in the ground.

14. Device according to claim 13, in which the second fixed part includes a distributor for distribution of gas into each envelope and means to control the filling and explosion of the fluid in each of the envelopes.

15. Device according to claim 12, including an incrementation control system for the filling and explosion of the fluid in each of the envelopes in succession.

16. Device according to claim 12, in which each container is cylindrical in shape and includes a first end which is closed at the bottom and a second end closed by an ejectable cover, the aforesaid cover being in the shape of a cone.

17. Device according to claim 16, in which the bottom of the container is pierced by a gas supply tube, the aforesaid tube going through the cylindrical container essentially along its axis of symmetry and stopping at the conical cap with a diffuser to which the envelope is attached, the aforesaid diffuser being used to put the fluid into the envelope.

18. Device according to claim 17, in which the diffuser includes a venturi system, the aforesaid venturi system including an orifice for suction of the surrounding atmospheric air around the conical cap.

19. Device according to claim 8, in which the gas is hydrogen.

20. Device according to claim 7, in which the flexible envelopes used are weather balloons with a volume of 10 $m^3$.

21. Device according to claim 7, in which the material of the envelope is chosen from the group including butyl rubber.

* * * * *